United States Patent [19]

Harder

[11] Patent Number: 4,583,693

[45] Date of Patent: Apr. 22, 1986

[54] DUMP BODY SPREADER

[76] Inventor: Kenneth A. Harder, 2480 Zurich Rd., Newark, N.Y. 14513

[21] Appl. No.: 651,521

[22] Filed: Sep. 17, 1984

[51] Int. Cl.[4] ..... E01C 19/00; B60P 1/00

[52] U.S. Cl. ..... 239/657; 239/672; 239/687; 298/23 D; 414/491

[58] Field of Search ..... 239/657, 675, 665, 666, 239/668, 672, 676, 679, 681, 687; 414/488, 489, 491; 222/164, 166; 298/23 D

[56] References Cited

U.S. PATENT DOCUMENTS

| | | | |
|---|---|---|---|
| 1,642,747 | 9/1927 | Richardson | 239/657 X |
| 2,338,320 | 1/1944 | Donovan et al. | 239/657 |
| 2,681,090 | 6/1954 | Hicks et al. | 239/657 |
| 2,969,987 | 1/1961 | Debiasi | 239/657 |
| 3,158,375 | 11/1964 | Vig | 239/665 X |
| 3,559,894 | 2/1971 | Murray et al. | 239/672 |
| 3,583,645 | 6/1971 | Lorenc et al. | 239/657 |
| 3,768,737 | 10/1973 | Tobias | 239/666 |
| 3,790,090 | 2/1974 | Murray | 239/676 X |
| 4,253,612 | 3/1981 | Schulze | 239/672 |

FOREIGN PATENT DOCUMENTS 2041804 2/1972 Fed. Rep. of Germany ..... 239/665

*Primary Examiner*—Jeffrey V. Nase
*Assistant Examiner*—David P. Davidson
*Attorney, Agent, or Firm*—Stonebraker, Shepard & Stephens

[57] ABSTRACT

A spreader 10, cooperating with a dump body 11 having a conventional tailgate 20, includes a conveyor 15 extending through an opening 12 in the lower region of tailgate 20 to rest on bottom 13 of body 11 and extend aft of tailgate 20. A hopper 30 underneath a rear end of conveyor 15 receives rearward flowing material that it guides downward to a spinner 50 arranged below hopper 30. Telescoping pipes 51 and 52 adjust the height of spinner 50 below hopper 30 and pivot spinner 50 between a horizontal stowed position and a vertical operating position. Conveyor 15 is pivotally connected to tailgate 20 so that as tailgate 20 pivots open when body 11 dumps, conveyor 15 moves with pivoting tailgate 20, sliding rearwardly of body 11 and lifting a rear region of conveyor 15 clear of bottom 13 of body 11.

15 Claims, 7 Drawing Figures

DUMP BODY SPREADER

BACKGROUND

Highway spreaders for salt, sand, and cinders generally use hopper bodies. These have a bottom conveyor extending the full length of the body, which has sidewalls sloping down to the conveyor in hopper fashion. The conveyor feeds the load from the hopper out a rear opening to a spinner.

My experience shows many disadvantages in hopper bodies, including: they are expensive to purchase; they require full-length conveyors and must be available in several body and conveyor lengths; they take considerable time and labor to mount on a truck chassis or in a truck body; they are large and require considerable storage space when not in use; they raise the load to a high center of gravity, which is dangerous for the truck and driver; they cannot be dumped; they must be cleaned, sandblasted, and painted frequently; they retain corrosive salt in inaccessible places so that they rust out prematurely; they can clog with lumps and are dangerous to unclog; and because they are costly to remove and reinstall, they limit a truck to spreading duty when mounted and to non-spreading work when unmounted.

I have discovered a way of arranging a conveyor and spreader in a conventional dump truck body to accommodate both spreading and dumping and to achieve many advantages in economy, efficiency, and safety. My combination of a conveyor and spreader mounted in a conventional dump truck body aims at reliability, economy, ease of installation, safety, and versatility in operation.

SUMMARY OF THE INVENTION

My spreader cooperates with a dump body having a pivotally mounted tailgate with an opening in its lower central region above its lower edge. A conveyor is arranged to extend through the opening in the tailgate and forward into the truck body so that when the tailgate is closed, the conveyor rests on the bottom of the body and extends aft through the opening above the lower edge of the tailgate. A hopper arranged underneath a rear end of the conveyor aft of the tailgate receives rearward flowing material from the conveyor and guides the material downward. A spinner mounted at an adjustable height below the hopper on a telescoping pipe can be pivoted between a horizontal stowed position and a vertical operating position. The conveyor is pivotally connected to the tailgate so that as the tailgate swings open when the dump body dumps, the conveyor moves with the pivoting tailgate, sliding rearwardly of the body and lifting a rear region of the conveyor clear of the bottom of the body.

DRAWINGS

DETAILED DESCRIPTION

Figure 1:
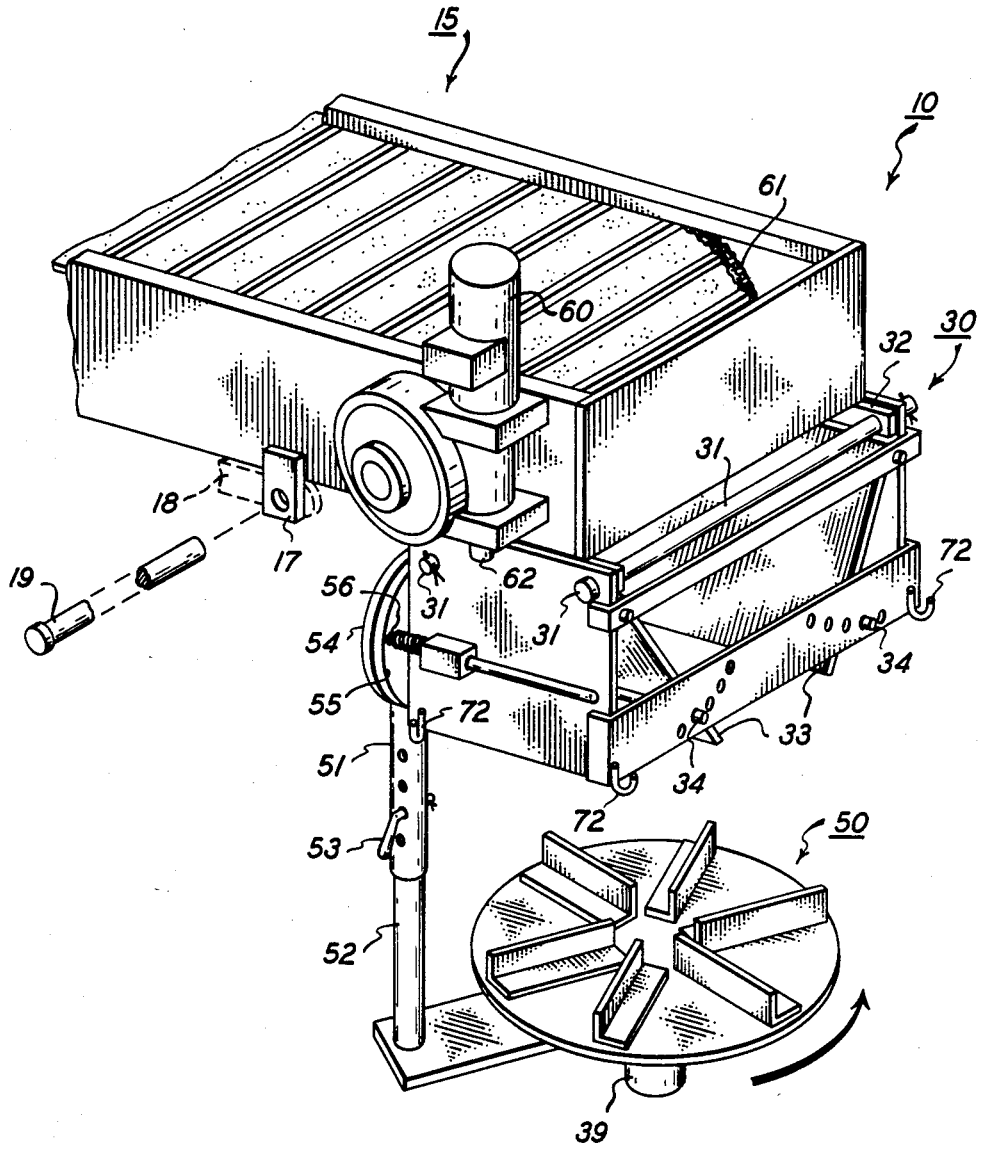
FIG. 1 is a perspective view of a rear end region of a preferred embodiment of my spreader shown separately from a dump truck.

My spreader 10 combines a conveyor 15, a hopper 30, and a spinner 50 to cooperate with each other and with a dump truck body 11 in which spreader 10 mounts. The preferred way this is done and the advantages it achieves are explained below.

CONVEYOR

A conventional dump truck body 11 can mount spreader 10 by forming an opening 12 in the lower central region of tailgate 20 and inserting conveyor 15 through opening 12 to extend forward along the bottom 13 of dump body 11. A metering door (not shown) can be arranged within tailgate opening 12 above conveyor 15. For highway spreader purposes, I prefer that conveyor 15 be a flight bar conveyor, but auger conveyors are also possible.

Figure 2:
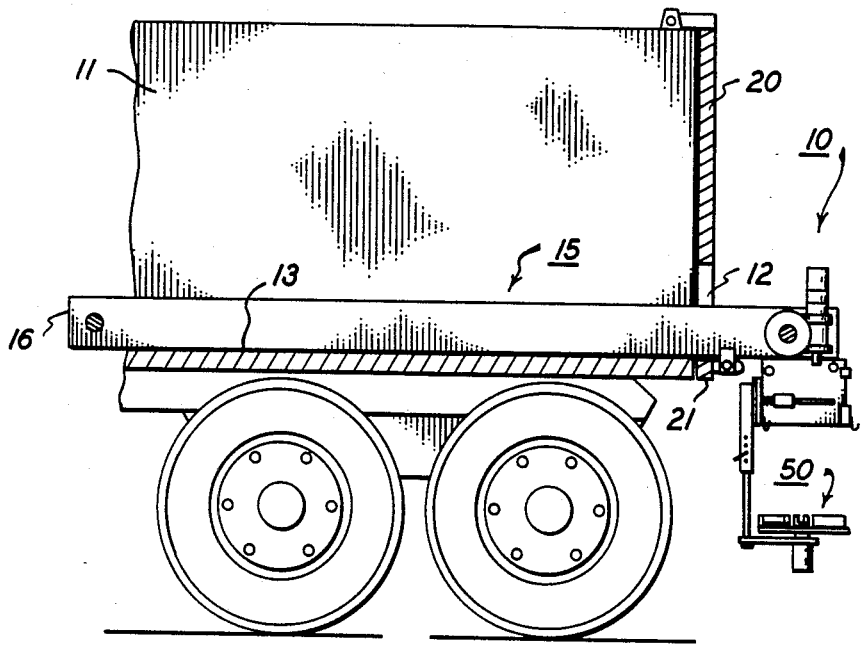
FIG. 2 is a partially cutaway and partially schematic view of a preferred embodiment of my spreader mounted in a dump truck.

Conveyor 15 preferably extends about 9½ feet forward of tailgate 20 into body 11. This allows conveyor 15 to fit into 10-foot dump bodies on 6-wheeled trucks. It also leaves the forward end 16 of conveyor 15 spaced several feet from the forward end of a 10-wheeler dump body, which can run to 14 feet. With tailgate 20 normally closed, as shown in FIG. 2, conveyor 15 rests on bottom 13 of body 11 and can be operated to outfeed whatever material within body 11 falls onto conveyor 15.

Since dump body 11 for a conventional dump truck is generally rectangular and cannot guide its entire load onto conveyor 15, unfeedable material will remain ahead of the forward end 16 and along both sides of conveyor 15. I have discovered that for several reasons this is not really a disadvantage.

Unfeedable portions of the load can be used for ballast, improving the safety of the truck. For example, the forward part of a load that does not flow onto the forward end 16 of conveyor 15 can be deliberately left in body 11 to provide ballast weight on the front wheels of the truck, improving its steering ability on slippery roads. Unfed materials along the sides of conveyor 15 can also be deliberately left in place to afford general ballast increasing the truck's driving traction.

The truck driver can also choose between leaving ballast material around body 11 outside of conveyor 15 or spreading such material. He can do this by tilting body 11 upward, without opening tailgate 20, to shift the unspread load aft against tailgate 20 where it piles up, covers conveyor 15, and becomes spreadable. All but a few bushels of material in the rear corners of body 11 can be spread after raising body 11, shifting the unspread load aft, and lowering body 11 back down for spreading.

Inability to spread the entire load is not an actual disadvantage, especially when ballast retention is preferred for operation on slippery roads. Whatever the state of the load, its center of gravity stays much lower in body 11 than in a hopper body; and this also helps make the truck stable and safe.

The possibility of shifting the load aft by raising dump body 11 also eliminates the need for varying lengths of conveyors 15 to fit varying lengths of truck bodies. Since material forward of conveyor 15 can be spread after shifting it aft against tailgate 20, there is no need for conveyor 15 to extend all the way to the forward end of body 11. This allows my spreader 10 to be made in one standard size that fits all dump bodies. It also keeps conveyor 15 relatively short so that it can be driven with moderate power, has a small frictional drag, and requires minimum length replacement chains or belts.

Conveyor 16 is preferably pinned to the lower rail 21 of tailgate 20 by a pin 19 passing through brackets 17 on conveyor 15 and rings 18 welded to bottom rail 21. Opening 12 in tailgate 20 extends down to bottom rail 21 where it is flush with bottom 13 of body 11 so that conveyor 15 rests on bottom 13 and extends loosely through opening 12 just above bottom rail 21 when tailgate 20 is closed. Pin 19 allows relative pivotal motion between tailgate 20 and conveyor 15 and also makes conveyor 15 move with tailgate 20 as it pivots open as shown in FIG. 3.

Figure 3:
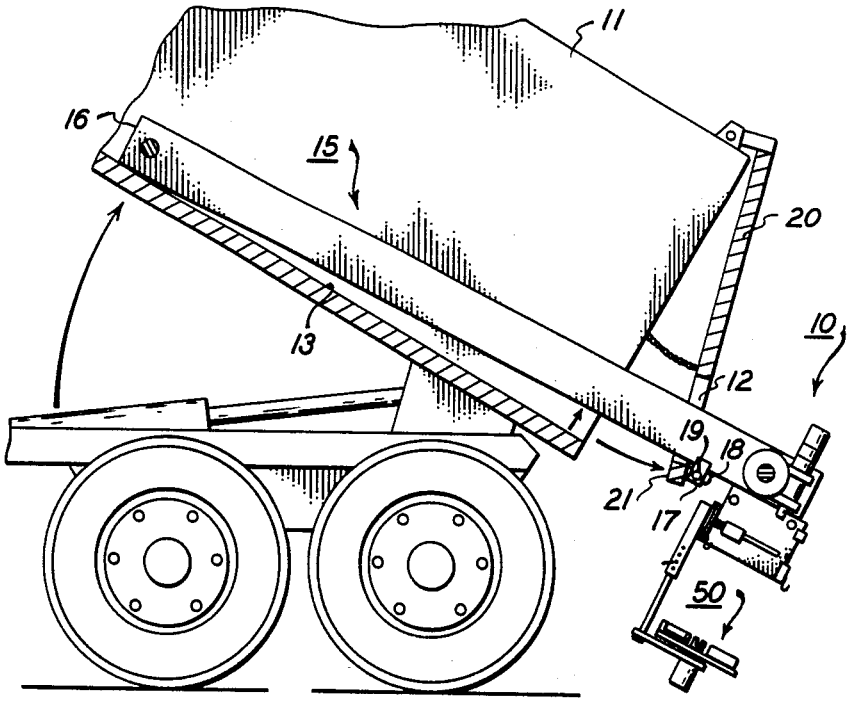
FIG. 3 is a partially cutaway and partially schematic view, similar to the view of FIG. 2, showing my spreader in a dumping position.

Any unspread residue, ballast, or even an entire load can be dumped from body 11 through open tailgate 20 with spreader 10 in place as shown in FIG. 3. This can be important on many occasions. Unspreadable lumps that remain after a spreading run can be dumped at a loading station, ballast desirable for safe operations can be returned to a loading site, and body 11 can be emptied of whatever it contains for filling with a different material or for removing spreader 10.

Another advantage of pivotally connecting conveyor 15 and tailgate 20 is that body 11 is self-cleaning when dumped. As tailgate 20 pivots open, as shown in FIG. 3, a rear region of conveyor 15 lifts off of bottom 13 of body 11, leaving only nose end 16 touching bottom 13. Any particles that have made their way to the underside of conveyor 15 are freed as conveyor 15 lifts off of bottom 13 so that everything spills out of body 11 when it is dumped.

This affords an important advantage over hopper and other spreader bodies, which cannot dump and which accumulate spread materials in inaccessible corners and crevices. Non-dumping bodies have to be frequently cleaned, sandblasted, and painted, partly because they cannot completely rid themselves of all residue of the materials they have spread. This is especially serious in spreading rock salt, which is corrosive and makes hopper bodies rust out rapidly.

As body 11 lowers to its normal position after dumping a load, the weight of spreader 10 pinned to tailgate 20 automatically closes tailgate 20 to a latched position. This eliminates any need for moving the truck forward and braking suddenly to be sure that tailgate 20 fully closes.

Spreader 10 is easily installed and removed from body 11. It can be gripped just aft of its center of gravity and lifted by a loader or hoist with the help of a worker bearing down slightly on the rear end of conveyor 15 to lift and steer the nose end 16 through tailgate opening 12 and onto the bottom 13 of body 11. Once moved into the position shown in FIG. 2, conveyor 15 is simply pinned to tailgate 20. Connecting up the hydraulic lines then makes spreader 10 operable. Reversing the procedure removes spreader 10 from the truck, and an installation or removal requires only a few minutes.

Spreader 10 is relatively compact and requires little room for storage when not in use. Its self-cleaning ability when body 11 dumps makes it easy to maintain.

Figure 6:
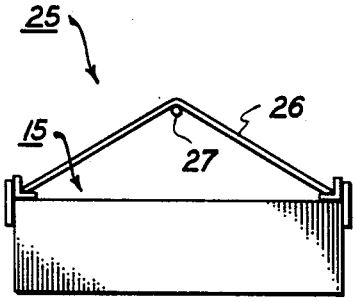
FIG. 6 is a fragmentary end view of a separator screen for the conveyor of my spreader.
Figure 7:
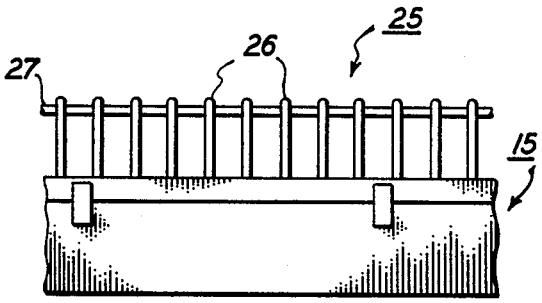
FIG. 7 is a fragmentary side elevational view of the separator screen of FIG. 5.

Conveyor 15 can have a separator screen 25 as shown in FIGS. 6 and 7 for keeping unspreadable lumps away from the conveyor flight bars. Screen 25 is preferably formed of a series of bars 26 rising from each side of conveyor 15 to a peak bar 27. Bars 26 are preferably spaced about 3 inches apart along the length of conveyor 15 and are analogous to rafters extending up to ridge bar 27. Lumps wider than the space between bars 26 cannot pass through and get onto conveyor 15. As the load is spread, such lumps have freedom to move down the side slope of bars 26 and end up as unspread material alongside conveyor 15. Such lumps can then be harmlessly dumped when the truck returns to a loading station.

A separating screen over the conveyor of a hopper body would not be practical because there is no region alongside the conveyor where separated lumps can accumulate, and there is no way to dump separated lumps from a hopper body. Hopper bodies sometimes have screens over their tops to keep lumpy material from entering, but this has the disadvantage of accumulating lumps on top of the hopper body. Workers have been killed falling from the tops of hopper bodies where they were working to break down lumps so that they would pass through a screen.

HOPPER AND SPINNER

Hopper 30 is a box-like structure arranged under the rear end of conveyor 15 to direct spread material downward to spinner 50. A pair of side deflector plates 33 can be adjusted to various angular positions set by pins 34 to control the convergence of the downflow of spread material.

A pair of pins 31 attach hopper 30 to the rear end of conveyor 15 by extending through mating holes in the upper region of hopper 30 and brackets 32 underneath conveyor 15. This makes hopper 30 readily removable and reattachable to conveyor 15.

A pair of telescoping pipes 51 and 52 support spinner 50 at an adjustable vertical distance below hopper 30. A pin 53 lodged in mating holes in pipes 51 and 52 sets the vertical height for spinner 50. Besides accomplishing vertical adjustability, telescoping pipes 51 and 52 are simple and easily straightened or replaced if bent.

Figure 4:
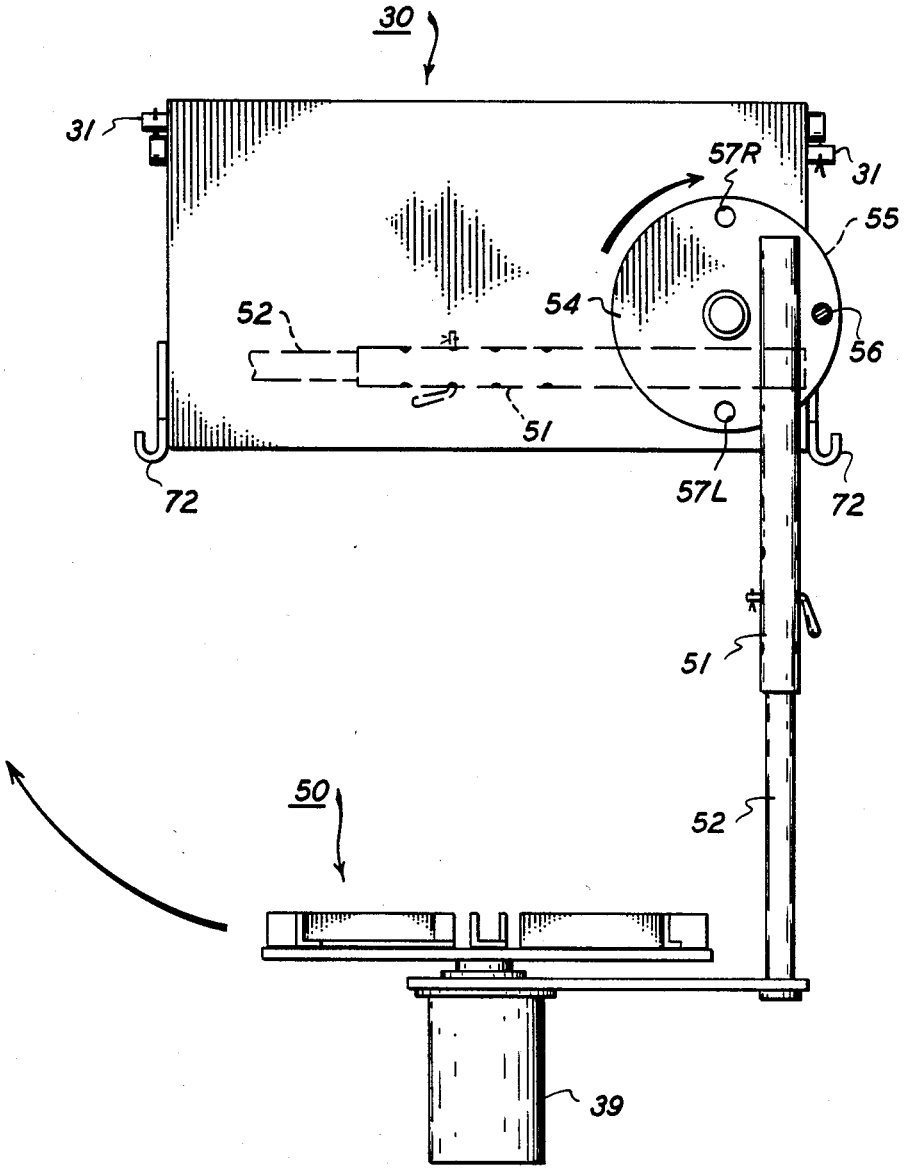
FIG. 4 is an elevational view of the hopper and spinner of the spreader of FIGS. 1–3 as viewed looking rearwardly from the tailgate of a dump truck.
Figure 5:
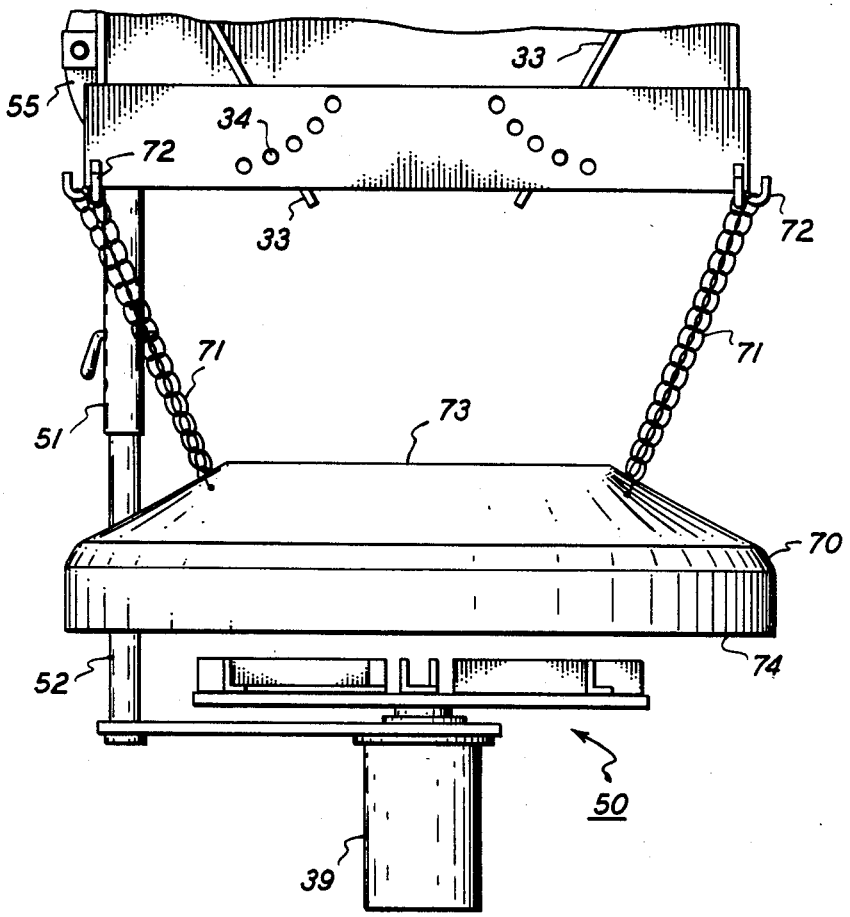
FIG. 5 is a fragmentary rear elevational view of a preferred shroud suspended above the spinner of my spreader.

Pipe 51 is mounted on a disk 54 that is rotatable relative to a fixed disk 55 fastened to the front of hopper 30. A movable detent pin 56 locks disks 54 and 55 together to hold spinner 50 in either the vertical operating position shown in FIGS. 1 and 4 or in a horizontal stowed position as shown in broken lines in FIG. 4. Hole 57R in movable disk 54 detents with pin 56 in a stowed position that normally disposes spinner 50 toward the right side of the truck and hole 57L is available to stow spinner 50 toward the left side of the truck if desired.

Spinner 50 can be moved to a stowed position simply by withdrawing detent pin 56 and manually pivoting spinner 50 counterclockwise up to its horizontal stowed position. This can easily get spinner 50 out of the way for storage, transport, or use of the truck for towing, for example.

The operating position of spinner 50 is arranged to clear the road bed and swing under the rear of the truck when body 11 is dumped as shown in FIG. 3. Driving the truck away from a dumped load removes spinner 50 intact. Any collision or mishap to spinner 50 is easily repaired by straightening or replacing telescoping pipes 51 and 52.

Spinner 50 is preferably driven by a hydraulic motor 39 located under spinner 50. Another hydraulic motor 60 turns the drive sprockets 61 at the rear of conveyor 15. A stub shaft 62 on sprocket motor 60 affords an available connection to a rotation-sensing device for microprocessor control of conveyor 15. This can automatically compensate for relative truck speeds and spreading rates as the truck moves up and down hills, for example.

A shroud 70, preferably formed of a used automobile tire that is inverted and has one sidewall cut away, hangs by four chains 71 attached to four hooks 72 on hopper 30. Material falling downward onto spreader 50 passes through the upper rim section 73 of shroud 70 and is spun outward under the wider cutaway side 74 of shroud 70. By changing the links of chains 71 hung on hooks 72, shroud 70 can be set to control the trajectory of the spread material. Forming shroud 70 of a used automobile tire makes it practically indestructible, very inexpensive, widely adjustable, and practically effective in controlling the spread trajectory.

For off-season storage, spinner 50 is preferably moved to its stowed position adjacent hopper 30, whereupon pairs of spreaders 10 can be inverted and stacked with their hoppers at opposite ends. Hoppers 30 can also be removed from conveyors 15 for separate storage.

My spreader 10 has proven convenient and successful at spreading rock salt, sand, and cinders on winter highways. I have also found my spreader to be effective at spreading fine crushed stone on highways being resurfaced. The features my spreader combines make it more convenient, economical, and versatile than any existing spreaders.

I claim:

1. A spreader arranged to cooperate with a dump body having a tailgate pivotally mounted at an upper region of said body and closeable at a bottom region of said body along a lower edge of said tailgate, said spreader comprising:

a. said tailgate having an opening in a lower central region above said lower edge;

b. a conveyor arranged to extend through said opening in said tailgate and forward into said body so that in a closed position of said tailgate, said conveyor rests on said bottom of said body and extends aft through said opening above said lower edge of said tailgate;

c. a hopper arranged underneath a rear end region of said conveyor aft of said tailgate for receiving rearward flowing material from said conveyor and guiding said material in a downward flow;

d. a spinner arranged below said hopper;

e. a telescoping pipe mount arranged on said hopper for supporting said spinner at adjustable heights below said hopper;

f. means for pivoting said telescoping pipe mount and said spinner between a horizontal stowed position and a vertical operating position; and g. means for pivotally connecting said conveyor to said tailgate so that as said tailgate pivots to an open position when said dump body dumps, said conveyor moves with said pivoting tailgate, sliding rearwardly of said body and lifting a rear region of said conveyor clear of said bottom of said body.

2. The spreader of claim 1 including a shroud suspended from said hopper in a vertically adjustable position above said spinner.

3. The spreader of claim 2 wherein said shroud is formed of an inverted automobile tire with one sidewall cut away.

4. The spreader of claim 3 including a plurality of hooks on said hopper and a plurality of chains on said shroud for vertically adjusting said shroud relative to said spinner.

5. The spreader of claim 1 including a separator screen formed as a plurality of parallel bars inclined upward from opposite sides of said conveyor to a ridge spaced above said conveyor and extending longitudinally of said conveyor.

6. The spreader of claim 1 including means for removably pinning said hopper to said conveyor.

7. The spreader of claim 6 wherein said hopper has adjustable deflector flaps for guiding flow of material onto said spinner.

8. The spreader of claim 6 including a pivot disk for said telescoping pipe mount and said spinner, and detents arranged in said pivot disk for holding said telescoping pipe mount and said spinner in said stowed position and said vertical operating position.

9. The spreader of claim 8 wherein said hopper has adjustable deflector flaps for guiding flow of material onto said spinner.

10. The spreader of claim 6 including a shroud suspended from said hopper in a vertically adjustable position above said spinner.

11. The spreader of claim 10 wherein said shroud is formed of an inverted automobile tire with one sidewall cut away.

12. The spreader of claim 6 including a separator screen formed as a plurality of parallel bars inclined upward from opposite sides of said conveyor to a ridge spaced above said conveyor and extending longitudinally of said conveyor.

13. The spreader of claim 12 wherein said hopper has adjustable deflector flaps for guiding flow of material onto said spinner.

14. The spreader of claim 13 including a pivot disk for said telescoping pipe mount and said spinner, and detents arranged in said pivot disk for holding said telescoping pipe mount and said spinner in said stowed position and said vertical operating position.

15. The spreader of claim 14 including a shroud suspended from said hopper in a vertically adjustable position above said spinner, said shroud being formed of an inverted automobile tire with one sidewall cut away, and a plurality of hooks on said hopper and a plurality of chains on said shroud for vertically adjusting said shroud relative to said spinner.

* * * * *